United States Patent [19]

Umezawa et al.

[11] 4,390,566

[45] Jun. 28, 1983

[54] METHOD OF PRODUCING SOFT SHEET

[75] Inventors: Masao Umezawa, Shiga; Miyoshi Okamoto, Takatsuki, both of Japan

[73] Assignee: Toray Industries, Inc., Japan

[21] Appl. No.: 241,634

[22] Filed: Mar. 9, 1981

[51] Int. Cl.[3] ..... B05D 5/00

[52] U.S. Cl. ..... 427/198; 8/112; 8/488; 26/29 R; 28/162; 156/72; 427/245; 427/336; 427/369; 427/389.9; 428/91

[58] Field of Search ..... 427/245, 198, 274, 335, 427/336, 369, 389.9, 412.5, 412, 392, 393.1, 393.2, 393.4, 393.3; 28/162; 26/29 R, 32; 428/1; 8/488, 112; 156/72

[56] References Cited

U.S. PATENT DOCUMENTS

| | | | |
|---|---|---|---|
| 3,706,613 | 12/1972 | Toki et al. | 156/85 |
| 4,073,988 | 2/1978 | Nishida et al. | 428/91 |
| 4,109,038 | 8/1978 | Hayashi et al. | 428/91 |
| 4,118,529 | 10/1978 | Nakagawa et al. | 428/91 |
| 4,206,257 | 6/1980 | Fukushima et al. | 428/91 |
| 4,230,073 | 11/1980 | Okamoto | 428/91 |

*Primary Examiner*—Michael R. Lusignan
*Assistant Examiner*—Thurman K. Page
*Attorney, Agent, or Firm*—Austin R. Miller

[57] ABSTRACT

In a methd for producing a soft sheet material containing thinned fibers or filaments and a viscoelastic substance, the improvement comprising:

(A) applying a mixture of a viscoelastic substance and a temporary filler to a sheet material containing thinnable fibers or filaments;

(B) thinning the thinnable fibers or filaments forming said sheet material;

(B') applying temporary filler to said sheet material or relocating said temporary filler applied previously at step (A) within said sheet material, whenever necessary;

(C) applying a viscoelastic substance;

(D) removing said temporary filler; and (E) napping the sheet, whenever necessary.

In accordance with the present invention, it is possible to obtain a leather-like sheet material which, though soft, has good mechanical properties such as high abrasion resistance and high tear strength. A leather-like sheet material is produced which is free from deficiencies such as low abrasion resistance and tear strength even where the thickness is further reduced.

30 Claims, No Drawings

METHOD OF PRODUCING SOFT SHEET

BACKGROUND OF THE INVENTION (1) Field of the Invention

This invention relates to a composite fibrous sheet, especially to a napped composite fibrous sheet which has good mechanical properties while also having the desired softness.

(2) Description of the Prior Art

The use of "artificial leather" produced by applying a viscoelastic substance to a fibrous sheet has been ever-increasing in recent years.

Uses include not only shoes, bags, upholstery and the like but also clothing. Typical requirements for artificial leather are that it must be soft and, at the same time, must have good mechanical properties such as high abrasion resistance and high tear strength. It must also have the desired surface appearance.

Various attempts have been made to satisfy these requirements, as exemplified by the following methods. British Pat. No. 1,300,268 discloses a typical method which comprises applying a rubber-like viscoelastic substance to a fibrous sheet consisting of specific fibers, such as "islands-in-a-sea" type fibers or filaments, and then removing part of the specific fibers such as the sea component in order to obtain a sheet material having a soft and pliable hand.

The method typified by U.S. Pat. No. 3,706,613 comprises applying first a soluble binder such as polyvinyl alcohol to a sheet consisting of specific fibers such as "islands-in-a-sea" type composite fibers or filaments, then removing part of the specific fibers such as, for example, the sea component to generate superfine fibers, applying a viscoelastic substance such as polyurethane or the like and thereafter removing the soluble binder. Various lubricants or softeners may be added to the binder or to the product to soften the product.

These methods have merit, but they also have the following critical problems. The sheet obtained by first applying a rubber-like viscoelastic substance and then removing one component of the specific fibers, as typified by the abovementioned British Pat. No. 1,300,268, produces a sheet having a soft hand. However, the sheet has low tensile strength due to gaps generated between the superfine fibers and the rubber-like viscoelastic substance. When the sheet is raised to produce a napped surface effect, the nap easily peels off, and yielding a serious drawback. Further, since the solvent for the viscoelastic substance is, in most cases, also a solvent for the fiber-forming components, application of the viscoelastic substance becomes extremely unstable and continuous production of uniform product is difficult.

In the method exemplified by U.S. Pat. No. 3,706,613, there is a high probability of the superfine fibers and the rubber-like viscoelastic substance being bonded directly to one another. This produces a product with a secure nap, but the bonded parts between the superfine fibers and the rubber-like viscoelastic substance are relatively large, yielding a product with a rubber-like hand which is undesirable in clothing.

Attempts have been made to improve the mechanical properties and hand of the sheet material by carrying out the following steps:

(a) forming a thinnable fiber aggregated sheet;

(b) applying a dispersion and/or solution of elastic polymer (A) to the fiber aggregated sheet before or after the fibers of the fiber aggregated sheet are temporarily fixed, and then coagulating the polymer (A);

(c) temporarily fixing the fibers if they are impregnated with the polymer (A) before they are temporarily fixed or if temporary fixing is not sufficient;

(d) smoothing the surface of the sheet fibers using a press or a calender roll if the surface is not sufficiently flat;

(e) impregnating the fiber aggregated sheet with a dispersion and/or solution of a polymer (B) consisting principally of an elastic polymer and coagulating the polymer (B);

(f) removing the temporary fixing paste when the temporary fixing paste is used for temporary fixing;

(g) dissolving or decomposing and removing part or the whole of the matrix components of the fibers, thereby changing the fibers into bundles consisting of a number of thin fibers of small denier;

(h) raising one or both surfaces of the dried sheet to form napped surface or surfaces; and (i) applying other necessary finish treatments such as dying, softening and the like.

This method is not completely satisfactory. Due to a lack of bonding between the rubber-like viscoelastic substance and the fibers forming the sheet, the tensile strength is not improved and the nap easily peels off the napped sheet. When a lubricant is added to the binder or applied to the product, particularly in apparel applications, a softening effect is achieved. However, this lubricant easily bleeds out and is removed during cleaning, leaving an uncomfortable garment with a harsh hand.

SUMMARY OF THE INVENTION

The present invention is therefore directed to providing a method of producing a sheet material which method eliminates the abovementioned drawbacks of the conventional methods.

It is an object of the present invention to provide a method of producing a composite fibrous sheet material having a very soft hand and good mechanical properties simultaneously and if desired a beautifully napped surface.

It is another object of the present invention to provide a high-grade, artificial leather-like napped sheet which, even though thinner than the conventional leather-like artificial sheets, has strength substantially equal to or larger than that of the conventional sheets and has a very soft hand.

In producing a soft sheet by applying a viscoelastic substance to thinnable fibers or filaments, the first method of producing a soft sheet material in accordance with the present invention comprises:

(A) applying a mixture of viscoelastic substance and a temporary filler to a sheet material containing thinnable fibers or filaments;

(B) thinning the thinnable fibers or filaments forming the sheet material;

(C) applying the viscoelastic substance to the sheet material;

(D) removing the temporary filler; and (E) napping the sheet material if necessary.

The second method of producing a soft sheet material in accordance with the present invention comprises:

(A) applying a mixture of a viscoelastic substance and a temporary filler to a sheet material consisting of thinnable fibers or filaments;

(B) thinning the thinnable fibers or filaments forming the sheet material;

(B') applying additional temporary filler to the sheet material or relocating the temporary filler applied at step (A) within the sheet material;

(C) applying viscoelastic material;

(D) removing the temporary filler; and (E) napping the sheet, whenever necessary.

DESCRIPTION OF THE PREFERRED EMBODIMENTS

The term "thinnable fibers or filaments" used in this invention refers to those fibers which become thinner by chemical, mechanical or thermal treatment or by a combination of these treatments. A typical example of such fibers or filaments is the "islands-in-a-sea" type disclosed in British Patent Specification Nos. 1,171,843 and 1,300,268. In addition to the "islands-in-a-sea" type composite fibers or filaments disclosed in these patent specifications, the "islands-in-a-sea" type fibers or filaments further include so-called "polymer blend fibers" or filaments. As polymer blend fibers or filaments both those types which generate long fibers upon the thinning treatment and those types which generate short fibers can be used in the present invention. In the conventional methods, when the polymer blend fibers or filaments of the short fibril type are used, the resulting sheet-like material tends to have poor properties; the method of the present invention can eliminate this problem and yield a product with good properties.

The abovementioned "islands-in-a-sea" type fibers or filaments may be defined as multi-component type fibers or filaments which generate a number of thinner fibers or filaments when at least one component (generally the sea component) is removed from the multi-component type fiber or filament. In such "islands-in-a-sea" type fibers or filaments, the number of island components dispersed in the sea component is usually at least 4 and preferably 8 or more in the fiber cross-section.

In the abovementioned "thinnable fibers or filaments" are included"split type" fibers or filaments which can be divided into a number of thinner fibers or filaments by mechanical, chemical or thermal treatment or by a combination of these treatments. Such split type fibers or filaments are disclosed, for example, in U.S. Pat. Nos. 4,109,038; 4,051,287; 4,073,988 and 4,165,556.

Further, the "thinnable fibers" or filaments in the present invention include bimetal composite fibers or filaments and those sheath-and-core type fibers or filaments which generate thinner fibers when divided or when at least one component thereof is removed. The "islands-in-a-sea" type fibers or filaments are especially preferred.

The size of the superfine fibers or filaments generated as a result of thinning the thinnable fibers or filaments is less than 1 denier, preferably below 0.8 denier, and more preferably below 0.3 denier.

The term "fibrous sheet" used herein includes non-woven fabric, knitted fabric, woven fabric, combinations thereof and such fabric treated with various binders. Particularly when non-woven fabric is used, the advantages of the present invention are readily apparent. These fibrous sheets may contain the thinnable fibers or filaments as the fibrous component within a range such that the objects of the present invention are achieved.

The fibrous sheet in the present invention may consist solely of the thinnable fibers or filaments especially in the case of making more soft sheets. In the case of a knitted or woven fabric, the thinnable fibers or filaments can be effectively used as part of the warp and weft forming the fabric. The quantity of thinnable fibers or filaments in the fabric to achieve the objects of the present invention is determined by such parameters as the structure of a knitted or woven fabric, the density of a non-woven fabric and other such variables. A napped product is produced most effectively from a standpoint of production cost, aesthetics and other product properties when thinnable fibers are used for at least the nap-forming fibers.

Next, a mixture of temporary filler and viscoelastic substance is applied to the abovementioned fibrous sheet.

As the viscoelastic substance, various types of polyurethane, various rubber-like substances such as NBR and various substances which exhibit viscoelasticity such as silicone rubber and fluororubber can be used. In other words, the well-known viscoelastic substances which are used for conventional artificial leather can be used in this invention. Two or more viscoelastic substances may be used in combination. The preferred viscoelastic substances are polymeric substances having elongation at break of at least 300% and stress at 100% elongation of up to 200 kg/cm$^2$. The measurement is made by testing a film-like sample (maximum thickness = 2 mm) which is free of structural defects such as having stress concentration or lacking orientation in a specific direction. The test method involves cutting a sample 5 mm-wide and 2 cm long and pulling the sample at a rate of 10 cm/min. at 20° C. ±2° C. and RH 65% ±2%.

As the viscoelastic substance, polyurethane is particularly preferred. Many types of polyurethane are known, and the various types of polyurethane used for artificial leather may be used in the present invention.

Polyurethane is a reaction product between a high-molecular weight polyol, an organic diisocyanate and a chain-extending agent. Examples of high-molecular weight polyol are polyether polyol, polyester polyol and the copolymer of polyether and polyester polyol. Typical examples of polyol are polycaprolactone diol, polytetramethylene ether glycol and the copolymer of polycaprolactone diol and polytetramethylene ether glycol, polyethylene adipate, polydiethylene adipate, polypropylene ether glycol and the like. A molecular weight of 800 to 4,000 is preferred.

Examples of suitable organic diisocyanates are aromatic diisocyanates such as diphenylmethane-4,4'-diiocyanate, tolylene diisocyanate, naphthylene diisocyanate, diphenyl diisocyanate and xylylene diisocyanate, and aliphatic diisocyanates such as hexamethylene diisocyanate, lysine diisocyanate and dicyclohexylmethane-4,4'-diisocyanate. Aromatic diisocyanates are especially effective where heat resistance is required. Aliphatic diisocyanates are especially effective where lightfastness is required.

As the chain-extending agents, diamines or di- or tri-functional alcohols of low molecular weights may be used. Examples of suitable diamines include aliphatic diamines such as hydrazine, ethylenediamine, propylenediamine, trimethylenediamine, tetramethylenediamine, pentamethylenediamine, hexamethylenediamine, 1,4-diaminopiperazine and 4,4'-diaminodicyclohexylmethane, and aromatic diamines such as phenylenediamine, tolylenediamine, p,p'-diaminodiphenylmethane and the like.

Examples of di- or tri-functional alcohols of low molecular weights are ethylene glycol, propylene glycol, butanediol, neopentyl glycol, 1,6-hexanediol, diethylene glycol, glycerin, trimethylolpropane and the like. They may be used in various combinations.

Preferred types of polyurethane are illustrated as follows:

(1) a polyurethane composition obtained by dissolving in a water-miscible organic solvent a substantially linear block polyether-polyester type polyurethane in which polytetramethylene ether glycol of a molecular weight of at least about 800 and polycaprolactone diol of a molecular weight of at least about 800 are bonded to the organic diisocyanate residues and to the diamine residues by urethane bonds and by urea bonds, and the weight ratio between the polytetramethylene glycol and the polycaprolactone diol is in the range of about 50/50 to about90/10 (as disclosed in Japanese Patent Publication No. 40143/1975, Okazaki et al.); and (2) a polyurethane emulsion consisting of water and polyurethane obtained by reacting an NCO group-excessive prepolymer between a polyol and a polyisocyanate with a chain-extending agent in the presence of water whereby the polyol consists of (A) polyester polyol of a molecular weight of 500 to 3,000, (B) polyoxyalkylene ($C_2$–$C_3$) polyol of a molecular weight of 200 to 5,000 and, if necessary, (C) polyol of a low molecular weight, the average mixed molecular weight of the mixture (A)+(B)+(C) is 1,000 to 3,000 and the weight ratio (A/B+C) is from 10 to 0.5 (as disclosed in Japanese Patent Laid-Open No. 155627/1977, Sugimoto et al.).

These polyurethanes are employed as a solution or as an emulsion.

As described previously, in the present invention, the viscoelastic substance is used at steps (A) and (C). As the viscoelastic substance used at step (A), it is preferable to use a three-dimensional crosslinked polymer. The term "three-dimensional crosslinked polymer" herein used refers to a polymer that is three-dimensionally crosslinked in advance as well as a polymer that can be three-dimensionally crosslinked after it is applied. In addition, the viscoelastic substance to be used at step (A) is preferably of the emulsion type. This broadens the selection range of treating agents for dissolving and removing at least one component of the thinnable fibers or filaments, or for treating these fibers or filaments as to make them easily divisible by use of a swelling agent. Furthermore, excessive swelling of the viscoelastic substance can also be restricted.

As the viscoelastic substance to be used, particularly at step (A), it is advisable to use those which can be dry-coagulated. An emulsion-type viscoelastic substance is preferred. As the viscoelastic substance to be used at step (C), it is advisable to use those which ca be wet-coagulated. Here, a solution-type viscoelastic substance is preferred. Such a combination makes it possible to markedly improve the strength of the resulting sheet, while the sheet remains soft.

Though not fully clarified, the mechanism through which both softness and good abrasion resistance and tear strength are achieved is suspected to be as follows. First, if a dry coagulation-type viscoelastic substance is employed at step (A), the substance migrates and tends to concentrate on the points of intersection bertween (among) the fibers or narrow parts between (among) the fibers at the time of dry coagulation, thus producing a sheet with high strength, capable of withstanding large deformation stress. next, if a wet coagulation-type viscoelastic substance is employed at step (C), migration of the viscoelastic substance does not occur at the time of wet coagulation and the viscoelastic substance is applied to sheets more uniformly than in the case of the dry coagulation. This yields a sheet capable of withstanding even small deformation stress. By the interaction of these mechanisms, the strength of the sheet is presumably increased as a whole. However, the present invention is not restricted to this particular combination. The objects of the present invention can be accomplished by combinations of dry coagulation-dry coagulation, wet coagulation-wet coagulation and wet coagulation-dry coagulation. It is assumed, further, that the softness of the sheet is developed by the use of a mixture of viscoelastic substance and temporary filler at step (A), reapplication of the temporary filler or its relocation at step (B') and removal of the temporary filler at sept (D).

As the temporary filler in the present invention, any material may be used as long as it can be selectively removed without dissolving and removing the viscoelastic substance and it is in solid form at room temperature. The temporary filler material should be a material which does not have a solvent in common with the viscoelastic material or if it does, it should remain solid at room temperature and not have a solvent common with the viscoelastic substance at that temperature. Such solvents may include:

(a) water, (b) alcohols of up to 15 carbon atoms, (c) esters of up to 15 carbon atoms, (d) ethers of up to 15 carbon atoms, (e) amines of up to 15 carbon atoms, (f) amides of up to 15 carbon atoms, (g) acetic acid and chloroacetic acid, (h) chlorinated hydrocarbon of up to 10 carbon atoms, and their mixtures.

Specific examples of temporary filler material include cellulosic materials such as starch, methylcellulose, or carboxymethylcellulose and polyvinyl alcohol and its copolymer with vinyl acetate. Also included are inorganic salts such as calcium carbonate. Generally, water-soluble materials are preferred because they can be extracted or subjected to the relocation treatment using water. Of them, water-soluble materials such as polyvinyl alcohol, carboxymethylcellulose and starch are preferred.

The mixture of the temporary filler and the viscoelastic substance to be employed at step (A) may be either a mixture in an aqueous system or a mixture in an organic solvent system. The temporary filler and the viscoelastic substance may be dissolved or dispersed in the liquid.

Whether or not the viscoelastic substance and the temporary filler have a common solvent, it is preferable that the mixture be homogeneous.

The mixing ratio of the temporary filler and the viscoelastic substance is not specifically restrictive but a preferred range for the viscoelastic substance is from 3 to 95% by weight and a specifically preferred range is from 5 to 93% by weight. If the content of the viscoelastic substance is below 3% by weight, the resulting product is of poor quality. Where the temporary filler is further applied after the thinnable fibers or filaments are thinned, this reduction in quality is intensified. For this reason, it is preferred that the content of the viscoelastic substance be more than 5% by weight.

If the amount of temporary filler in the mixture with the viscoelastic substance is small, the softness of the resulting sheet-like material becomes insufficient. For this reason, at least 5% by weight, more preferably 7% by weight, of the temporary filler should be used. If the content of the temporary filler is too great, the quality of the resulting sheet- like material would be lowered. Hence, the upper limit should be 97% by weight.

The deposition amount of the mixture of the temporary filler and the viscoelastic substance to the sheet varies markedly depending upon the kind of sheet, but generally, from 0.5% by weight up to 70% by weight of the mixture based on the weight of the thinnable fibers or filaments that form the sheet is applied. Below 0.5% by weight, properties of the product such as abrasion resistance would be lowered. Especially when fibers or filaments which are thinned by removing at least one of the components by chemical treatment or the like are employed in great quantities as the sheet-forming fibers or filaments, the deposition amount is preferably at least 1% by weight. Generally, the upper limit of the deposition amount is 50% by weight to obtain the desired hand. It is also advisable to use a greater deposition amount for non-woven fabric and a smaller deposition amount for knitted or woven fabric. For non-woven fabric, the advisable deposition amount is 10–50% by weight; for woven or knitted fabric the advisable deposition amount is 1–30% by weight. Various heretofore known methods may be used for deposition of the mixture, such as impregnation, spraying, coating, combinations of these methods and the like.

Next, the sheet-forming fibers or filaments are thinned. The term "thining" in this specification means to make the fibers thinner by chemical, thermal or mechanical treatment or the combination of these treatments, or to "fibrillate" the fiber. At times, the fibers or filaments need not all be thinned in the axial direction. Nor is it necessary that the fibers or filaments be divided so that they can be seen clearly with the naked eye. Hence, the term "thinning" also includes such a preparatory state from which the fibers or filaments can be divided by a subsequent simple treatment.

Various heretofore known thinning methods may be used as the thinning method in the present invention. In the so-called "islands-in-a-sea" type fibers or filaments such as the "islands-in-a-sea" type composite fibers or filaments or the polymer blend fibers or filaments or "sheath and core" type composite filaments or fibers treatment of the fibers or filaments with a solvent or a decomposition reagent to remove the sea component or the sheath component is most effective. By this method, superfine fibers or filaments are easily produced As a result, the method is especially effective for producing an extremely soft sheet product. If the fibers or filaments are composite fibers or filaments consisting of at least two polymers, each having different swellability to water, to a swelling agent, to other liquids or to heat, separation between the plural components by a swelling treatment or the like by utilizing the difference of swellability is also an effective method. Adding a foaming agent or the like to the fibers or filaments and foaming them is also recommended so that the fibers or filaments are thinned in the fibrillated form. The fiber size after thinning is preferably up to 0.8 denier and especially preferably up to 0.3 denier to achieve the desired hand with pliability, drapeability and suppleness.

The mode of thinning may be classified into the following two types. In the first type, a plurality of thinner fibers or filaments are generated by the thinning of the fibers or filaments such as when the "islands-in-a-sea" type composite fibers or filaments, the polymer blend fibers or filaments or the peel-split type fibers or filaments are used or when the bimetal-type composite fibers or filaments are split. In the second type, the fibers or filaments are not divided into a plurality of fibers or filaments even after thinning such as when one component is dissolved or decomposed and removed from the sheath and core type composite fibers or filaments or the bimetal-type fibers or filaments. Generally, the former type is preferred.

The viscoelastic substance is then applied to the thinned sheet. The viscoelastic substance may be the same as, or different from, the one previously applied. As described already, however, if the viscoelastic substance used at step (A) is a dry-coagulation type, the viscoelastic substance to be used at step (C) is preferably of a wet-coagulation type. In either case, it is preferred tha the viscoelastic substance be dissolved or dispersed in a liquid system which does not easily dissolve the temporary filler. The deposition amount varies markedly depending upon the type of the sheet, but the total deposition amount in steps (A) and (C) is preferably 1–100% of viscoelastic substance by weight based on the weight of the thinnable fiber sheet, more preferably at least 3% by weight. If the amount is below the lower limit, the sheet has low strength and creases occur on the sheet. In the case of a non-woven fabric sheet where the thinnable fibers or filaments occupy the major proportions of the fibers or filaments forming the non-woven fabric, it is preferred that about 15–80% by weight of the viscoelastic substance be applied.

When the viscoelastic substance is of the emulsion type and in usual case, it is useful to use heat-setting for making good mechanical properties, heat-setting may be practised in a suitable manner. When the viscoelastic substance is of the wet-coagulation type, it is possible to use known methods which sufficiently coagulate the viscoelastic substance, for example, dipping into a coagulation bath or the like. All types of known dry-coagulation methods or wet-coagulation methods may be used.

Subsequently, the temporary filler is removed. There are various methods of removing the filler, but the dissolving method is the most common. A sheet obtained in this manner has extremely good mechanical properties and has a soft hand. If further softening of the sheet is desired, temporary filler may be reapplied to the sheet or the temporary filler may be relocated in the sheet, after steps (A) and (B). This is the "second method", especially step (B'). If the temporary filler is again applied, it may be the same as, or different from, the one applied previously. If relocation of the temporary filler is chosen, the relocation of the temporary filler can be effected by passing the sheet in the solvent of the temporary filler, or by applying mechanical stress to the sheet, such as by pressing the sheet through a mangle or by applying vibration to the sheet while the sheet is being passed through the solvent of the temporary filler. The term "relocation" hereby means that the relative position of the temporary filler to the viscoelastic substance and to the fibers or filaments in the sheet is changed. The mechanism of the increase in softness in the product due to the relocation of the temporary filler has not yet been fully clarified. It is assumed, however, that part of the temporary filler migrates and covers at least part of the viscoelastic substance or at least part of the surface of the thinned fibers or filaments.

Where the temporary filler is reapplied, it is not necessary that the filler be applied separately. Hence, a mixture of the temporary filler and the viscoelastic material may be applied. At times, the deposition amount need not be increased as described in the case of the relocation of the temporary filler. When greater softness is required, at least 3% by weight, based on the weight of the thinnable fibers or filaments of the sheet, of the temporary filler must be applied at this time. Generally, this deposition amount is up to about 80% by weight.

Subsequently, the viscoelastic substance is applied. Examples of the viscoelastic substance applied at this point are the same as those illustrated above and the deposition amount is also substantially the same. The total deposition amount of the viscoelastic substance is selected from the range of from 1 to 100% by weight based on the weight of the thinnable fibers or filaments of the sheet. When the viscoelastic substance is of the emulsion type and heat-setting is necessary for coagulating the substance in the same way as in the first method, heat-setting may be practised using standard methods. When the viscoelastic substance is of the wet-coagulation type, sufficient coagulation may be achieved for example by dipping in a coagulation bath or the like.

Thereafter, the temporary filler is removed. The method of removing the filler is the same as that illustrated in the first method where the filler is dissolved or decomposed for removal. The sheet obtained in this manner is extremely soft and has good mechanical properties. Moreover, the sheet surface is uniform.

The resulting sheet material may be further treated by raising to produce a napped sheet surface whenever necessary. The napping method is not particularly restrictive. Various heretofore known methods such as needle raising and buffing with emery paper, sandpaper or emery cloth may be used.

Where the napping treatment is used, an artificial leather which has good hand and pliant, beautiful surface and is similar to various natural raised leathers such as suede-like raised leather and a vicuna-like raised leather can be produced. The napping treatment also improves the softness. It is also possible, whether or not the napping treatment is used, to obtain a grained artificial leather by making a grained surface on at least one surface of the composite sheet.

In accordance with the method of the present invention, it becomes possible to produce a composite fibrous viscoelastic material impregnated with a viscoelastic substance which material, though soft, has good mechanical properties such as high abrasion resistance and high tensile strength and which can be used effectively for producing clothes, shoes, bags, upholstery and so forth. In comparison with the conventional high-grade sheet materials, therefore, the sheet material of the present invention can be made additionally thinner while maintaining its character. The present invention is capable of eliminating the problems with the conventional sheet materials in that their strength is markedly reduced and practical utility is lost when the thickness of the sheet material is reduced. The method of the present invention makes it possible to put a thinner sheet material into practical application.

Though several examples of the present invention will be illustrated in the following paragraphs, the present invention is in no way restricted by these examples.

The following polyurethanes were used in Examples 1 through 3 and Comparative Example 1.

(A) Emulsion type polyurethane (1) high-molecular weight polyol component: conjoint use of polyoxypropylene glycol (molecular weight approx. 1,000) and polyoxypropylenetriol (molecular weight approx. 1,000) in a weight ratio of 75:25.

(2) organic diisocyanate component: 2,4-tolylene diisocyanate (3) chain-extending agent: 4,4'-diamino-dicyclohexylmethane (B) Solution type polyurethane (1) high-molecular weight polyol component: conjoint use of polycaprolactone diol (molecular weight approx. 2,000) and polytetramethylene ether glycol (molecular weight approx. 2,000) in a weight ratio of 30:70.

EXAMPLE 1

A web was formed from "islands-in-a-sea" type composite fibers consisting of polyethylene terephthalate as the island component and polystyrene containing 20 mol % of 2-ethylhexyl-acrylate copolymerized therewith as the sea component and having a weight ratio of 50:50 between the island component and the sea component and size of 4.5d (the number of islands = 16, the size of each island component = 0.14d) and was needle-punched to yield a non-woven fabric. Thereafter, the non-woven fabric was treated with hot waer at 80° C. reducing the surface area by 23%. The weight of this non-woven fabric was 630 g/m$^2$. The non-woven fabric was then impregnated with a mixed solution of 5% by weight of polyvinyl alcohol as the temporary filler and 5% by weight of a polyurethane emulsion as the viscoelastic substance and 90% by weight of water, and was dry-coagulated at 100° C. for 10 minutes. The deposition amount of the mixture was 11% by weight on the basis of the "island-in-a-sea" type composite fibers. Thereafter, the sea component was removed using trichloroethylene, thereby thinning the fibers. The removal ratio was 98.5% by weight. After heat treatment at 150° C. for 10 minutes, a 7 wt. % polyurethane solution (solvent = dimethylformamide) was further applied and the fibers were wet-coagulated in water at room temperature, then dipped into hot water at 80° C. and passed through a mangle to remove the polyvinyl alcohol. This procedure of dipping into hot water and passing through a mangle was repeated 15 times.

The total deposition amount of the polyurethane thus applied was 41% by weight calculated as the solid content on the basis of the thinned fibers. The resulting sheet was sliced into two thinner sheets. Each sheet was buffed to form a napped surface and then dyed to produce an artificial leather. The resulting products were rich in softness, had dense nap and good mechanical properties. The abrasion resistance was 577 cycles and the tear strength was 1.0 kg in the transverse direction and 1.2 kg in the longitudinal direction. The abrasion resistance was measured by causing wear on the surface of the sheet using a rotary nylon brush and counting the number of rotations required to break the sheet. The tear strength was measured in accordance with method C stipulated in JIS L-1079.

COMPARATIVE EXAMPLE 1

The shrunk fabric as in Example 1 was treated a 10% polyvinyl alcohol solution (PVA solution), and dried, and after that the sea component of the fiber was removed with trichloroethylene as in Example 1. A polyurethane solution (15% concentration) using dimethylformamide (DMF) as the solvent was then applied. Wet coagulation of the polyurethane and removal of the PVA were carried out as in Example 1. The deposition amount of the polyurethane was 48% by weight on the basis of the thinned fibers. Slicing, buffing and dyeing were then carried out. The product was relatively soft (63 mm in the longitudinal direction and 45 mm in the transverse direction as measured in accordance with Clark method stipulated by JIS L-1079). However, the properties of product were low as the abrasion resistance was 225 cycles and the tear strength was 0.5 kg in the transverse direction and 0.7 kg in the longitudinal direction.

EXAMPLE 2

A web was formed "islands-in-a-sea" type composite fibers consisting of nylon 6 as the island component and polystyrene containing 18 mol % of 2-ethylhexyl-acrylate copolymerized therewith as the sea component and having an island-to-sea ratio of 55/45 (by weight), size of 5.5 d, the number of islands of 36 and a size of 0.08 d for each island component, and was needle-punched to yield a non-woven fabric. The resulting non-woven fabric was treated with hot water at 80° C. reducing the surface area by 29.5%. The weight of this felt was 595 g/m$^2$. The felt was then impregnated with a mixed solution consisting of 7% by weight of polyvinyl alcohol (PVA), 7% by weight of a polyurethane emulsion and 86% by weight water. It was then dry-coagulated at 100° C. for 10 minutes. The total deposition amount as the sum of PVA and polyurethane was 15% by weight on the basis of the weight of the thinnable fibers.

Next, the sea component was removed with trichloroethylene to thin the fibers. The removal ratio was 98.7% by weight. After heat-setting at 150° C. for 10 minutes, the sheet was impregnated with a dimethylformamide solution (DMF) solution) of polyurethane (12 wt. % concentration). The polyurethane was then wet-coagulated with the water at room temperature and the PVA was removed as in Example 1. The total deposition amount of the polyurethane emulsion and the polyurethane solution was 38.5% by weight calculated as the solid content on the basis of the thinned fibers. The sheet was sliced into two thinner sheets and the surface of each sheet was buffed, napped and then dyed to produce a suede-like artificial leather. The product was very soft (as soft as 58 mm in the longitudinal direction and 45 mm in the transverse direction in accordance with Clark method stipulated by JIS L-1079) and had an excellent nap. In addition, the product had enhanced properties such as abrasion resistance of 1,235 cycles and tear strength of 2.4 kg in the longitudinal direction and 1.5 kg in the transverse direction.

EXAMPLE 3

The thinned fiber fabric of Example 2 treated with PVA and emulsion polyurethane was passed through water at 60° C. for about one minute and then was passed through a mangle. This procedure of passing through the water and the mangle was repeated twice to relocate the PVA. Thereafter, the felt was dried. The PVA decreased 3% by weight.

The felt was further impregnated with a 16 wt. % DMF solution of polyurethane and (wet-coagulated with water at room temperature and the PVA was removed) in the same way as in Example 1. The total deposition amount of the emulsion-type polyurethane and the solution-type polyurethane was 41% by weight calculated as the solid content on the basis of the thinned fibers. The sheet was sliced into two thinner sheets, buffed and dyed to produce suede-like artificial leather. The product was rich in softness (as soft as 38 mm in the longitudinal direction and 28 mm in the transverse direction in accordance with the method stipulated by JIS-1079) and had a fine, beautiful nap and good mechanical properties. The abrasion resistance was 1,033 cycles and the tear strength was 2.6 kg in the longitudinal direction and 1.9 kg in the transverse direction.

What is claimed is:

1. A method of producing a soft sheet material containing thinned fibers or filaments and a viscoelastic substance, which method comprises:

(A) applying a mixture of a viscoelastic substance and a temporary filler to a sheet material containing thinnable fibers or filaments;

(B) thinning the thinnable fibers or filaments of said sheet material;

(C) applying a viscoelastic substance; and (D) removing said temporary filler.

2. A method of producing a solf sheet material containing thinned fibers or filaments and a viscoelastic substance, which method comprises:

(A) applying a mixture of a viscoelectric substance and a temporary filler to a sheet material containing thinnable fibers or filaments;

(B) thinning the thinnable fibers or filaments forming said sheet material;

(B') applying temporary filler to said sheet material;

(C) applying a viscoelastic substance; and (D) removing said temporary filler.

3. A method of producing a soft sheet material containing thinned fibers or filaments and a viscoelastic substance, which method comprises:

(A) applying a mixture of a viscoelastic substance and a temporary filler to a sheet material containing thinnable fibers or filaments;

(B) thinning the thinnable fibers or filaments forming said sheet material;

(B') relocating said temporary filler applied at step (A) within said sheet material;

(C) applying a viscoelastic substance; and (D) removing said temporary filler.

4. The method according to claim 1, 2 or 3 wherein a napping treatment is effected after said step (D).

5. The method accoding to claim 1, 2 or 3 wherein said thinnable fibers or filaments are "islands-in-a-sea" type fibers or filaments having at least four island components of up to 0.8 d.

6. The method according to claim 1, 2 or 3 wherein said thinnable fibers are "islands-in-a-sea" type composite fibers or filaments containing at least 8 island components of up to 0.3 d.

7. The method according to claim 1, 2 or 3 wherein said thinnable fibers or filaments are sheath and core type composite fibers or filaments.

8. The method according to claim 1, 2 or 3 wherein said thinnable fibers or filaments are split-type composite fibers or filaments.

9. The method according to claim 1, 2 or 3 wherein said sheet material containing said thinnable fibers or filaments is a fabric selected from the group consisting of a non-woven fabric, a woven fabric, a knitted fabric and a combination sheet thereof.

10. The method according to claim 1, 2 or 3 wherein said sheet material containing said thinnable fibers or filaments is a non-woven fabric.

11. The method according to claim 1, 2 or 3 wherein said viscoelastic substance is a polymer substance having elongation at break of at least 300% and stress at 100% elongation of not greater than 200 kg/cm$^2$.

12. The method according to claim 1, 2 or 3 wherein said viscoelastic substance is polyurethane.

13. The method according to claim 1, 2 or 3 wherein said viscoelastic substance is a polyurethane solution formed by dissolving in a water-miscible organic solvent a substantially linear block polyether-polyester type polyurethane in which polytetramethylene ether glycol of a molecular weight of at least about 800 and polycaprolactone diol of a molecular weight of at least about 800 are bonded to the organic diisocyanate residues and to the diamine residues by urethane bonds and by urea bonds and the weight ratio between the polytetramethylene ether glycol and polycaprolactone diol is in the range of about 50/50 to about 90/10.

14. The method according to claim 1, 2 or 3 wherein said viscoelastic substance is a polyurethane emulsion consisting of water and polyurethane obtained by reacting an NCO group-excessive prepolymer between a polyol and a polyisocyanate with a chain-extending agent in the presence of water whereby the polyol consists of (A) polyester polyol of a molecular weight of 500 to 3,000, (B) polyoxyalkylene ($C_2$–$C_3$) polyol of a molecular weight of 200 to 5,000 and, optionally, (C) polyol of a low molecular weight, the average mixed molecular weight of the mixture (A)+(B)+(C) is 1,000 to 3,000 and the weight ratio (A/B+C) is from 10 to 0.5.

15. The method according to claim 1, 2 or 3 wherein said viscoelastic substance to be employed at said step (A) is a three-dimensional crosslinked polymer.

16. The method according to claim 1, 2 or 3 wherein said viscoelastic substance to be employed at said step (A) is a viscoelastic substance capable of being dry-coagulated.

17. The method according to claim 1, 2 or 3 wherein said viscoelastic substance to be employed at said step (C) is a viscoelastic substance capable of being wet-coagulated.

18. The method according to claim 1, 2 or 3 wherein said temporary filler is a water-soluble polymer compound.

19. The method according to claim 1, 2 or 3 wherein said temporary filler is at least one temporary filler selected from the group consisting of polyvinyl alcohol, carboxymethylcellulose and starch.

20. The method according to claim 1, 2 or 3 wherein the mixing ratio of said viscoelastic substance in said mixture of said viscoelastic substance and said temporary filler is from about 3 to 95% by weight on the basis of the weight of said mixture.

21. The method according to claim 1, 2 or 3 wherein the mixing ratio of said viscoelastic substance in said mixture of said viscoelastic substance and said temporary filler is from about 5 to 95% by weight on the basis of the weight of said mixture.

22. The method according to claim 1, 2 or 3 wherein the deposition amount of said mixture of said viscoelastic substance and said temporary filler is such that said viscoelastic substance is about 0.5% to 70% by weight on the basis of the weight of said thinnable fibers or filaments forming said sheet material.

23. The method according to claim 1, 2 or 3 wherein the deposition amount of said mixture of said viscoelastic substance and said temporary filler is such that said viscoelastic substance is from about 1% to 50% by weight on the basis of the weight of said thinnable fibers or filaments forming said sheet material.

24. The method according to claim 1, 2 or 3 wherein the total deposition amount of said viscoelastic substance is in the range of from about 1% by weight to 100% by weight on the basis of the weight of said thinnable fibers or filaments forming said sheet material.

25. The method according to claim 1, 2 or 3 wherein said thinnable fibers or filaments are "islands-in-a-sea" type fibers or filaments and thinning of said thinnable fibers or filaments is effected by treating said "islands-in-a-sea" type fibers or filaments with a solvent decomposition agent for said sea component and removing said sea component.

26. The method according to claim 1, 2 or 3 wherein said thinnable fibers or filaments are sheath and core type fibers or filaments and thinning of said thinnable fibers or filaments is effected by treating said sheath and core type fibers or filaments with a solvent decomposition agent for said sheath and removing said sheath.

27. The method according to claim 1, 2 or 3 wherein said thinnable fibers or filaments are split-type composite fibers or filaments and thinning of said thinnable fibers or filaments is effected by splitting said split-type composite fibers or filaments by treatment with a swelling agent.

28. The method according to claim 2 wherein the deposition amount of said temporary filler which is applied further at step (B') is from about 3% by weight to 80% by weight on the basis of the weight of said thinnable fibers or filaments forming said sheet material.

29. The method according to claim 3 wherein the relocation of said temporary filler is effected by applying a solvent for said temporary filler to said sheet material and then applying mechanical stress to said sheet.

30. The method according to claim 1, 2 or 3 wherein the removal of said temporary filler is effected by dissolving said temporary filler with a solvent thereof.

* * * * *